US008702173B2

(12) United States Patent
Adams et al.

(10) Patent No.: US 8,702,173 B2
(45) Date of Patent: Apr. 22, 2014

(54) FURNITURE MEMBER POWERED HEADREST ROTATION AND RELEASE SYSTEM

(75) Inventors: Chad E. Adams, Perrysburg, OH (US); Larry P. LaPointe, Temperance, MI (US); Richard E. Marshall, Monroe, MI (US); Eric B. Harwood, Toledo, OH (US); Eugene O. Cole, II, Maumee, OH (US)

(73) Assignee: La-Z-Boy Incorporated, Monroe, MI (US)

( * ) Notice: Subject to any disclaimer, the term of this patent is extended or adjusted under 35 U.S.C. 154(b) by 740 days.

(21) Appl. No.: 12/902,578

(22) Filed: Oct. 12, 2010

(65) Prior Publication Data

US 2012/0086256 A1 Apr. 12, 2012

(51) Int. Cl.

| | |
|---|---|
| ***A47C 7/36*** | (2006.01) |
| ***A47C 7/38*** | (2006.01) |
| ***A47C 1/035*** | (2006.01) |
| ***A47C 1/037*** | (2006.01) |

(52) U.S. Cl.
USPC ..... 297/408; 297/85 M; 297/403

(58) Field of Classification Search
USPC ..... 297/408–410, 403, 85 M
See application file for complete search history.

(56) References Cited

U.S. PATENT DOCUMENTS

| | | | | |
|---|---|---|---|---|
| 3,936,091 A | | 2/1976 | Rabinowitz | |
| 4,190,286 A | * | 2/1980 | Bentley | 297/284.3 |
| 4,466,662 A | | 8/1984 | McDonald et al. | |
| 4,515,406 A | | 5/1985 | Fujiyama et al. | |
| 4,711,494 A | * | 12/1987 | Duvenkamp | 297/403 |
| 4,822,102 A | * | 4/1989 | Duvenkamp | 297/403 |
| 5,120,109 A | * | 6/1992 | Rangoni | 297/284.3 |
| 5,131,720 A | | 7/1992 | Nemoto | |
| 6,471,296 B2 | | 10/2002 | Lance | |
| 6,709,051 B2 | | 3/2004 | Schambre et al. | |
| 6,746,078 B2 | | 6/2004 | Breed | |
| 6,962,392 B2 | * | 11/2005 | O'Connor | 297/408 X |

(Continued)

FOREIGN PATENT DOCUMENTS

| | | |
|---|---|---|
| JP | 2005177227 | 7/2005 |
| JP | 2009096385 | 5/2009 |

OTHER PUBLICATIONS

International Search Report for PCT/US2011/047366; Mailed: Apr. 9, 2012.

(Continued)

*Primary Examiner* — Rodney B White
(74) *Attorney, Agent, or Firm* — Harness, Dickey & Pierce, P.L.C.

(57) ABSTRACT

A powered headrest operating system includes a headrest connected to a seatback frame using rotational pins. An actuation mechanism rotatably connected to the seatback frame has a power actuated member connected to the headrest operating between retracted and extended positions to rotate the headrest from a fully retracted to a forward rotated position about an axis of rotation of the rotational pins. A release system rotatably connecting the headrest to the actuation mechanism retains the headrest at any forward rotated position while the actuation mechanism returns the power actuated member from the extended to the retracted positions if the headrest encounters an object blocking return to the retracted position. A biasing member connected to the seatback frame and the headrest creating a biasing force during headrest rotation away from the retracted position operates without actuation mechanism operating force to bias the headrest frame assembly toward the retracted position.

23 Claims, 12 Drawing Sheets

(56) References Cited

U.S. PATENT DOCUMENTS

| | | | | |
|---|---|---|---|---|
| 7,017,989 | B2 | 3/2006 | Yamaguchi et al. | |
| 7,121,625 | B2 | 10/2006 | Malsch et al. | |
| 7,234,778 | B1 | 6/2007 | Toba | |
| 7,237,843 | B2 * | 7/2007 | Clark et al. | 297/408 |
| 7,390,058 | B2 | 6/2008 | Sakai et al. | |
| 7,458,640 | B1 | 12/2008 | Hill | |
| 7,631,930 | B2 * | 12/2009 | Muller et al. | 297/408 X |
| 7,724,278 | B2 | 5/2010 | Maguire, Jr. | |
| 7,845,729 | B2 * | 12/2010 | Yamada et al. | 297/284.1 |
| 7,984,945 | B2 * | 7/2011 | Sayama | 297/216.12 |
| 8,056,983 | B2 * | 11/2011 | Adams et al. | 297/408 |
| 2004/0195895 | A1 * | 10/2004 | Sedlatschek et al. | 297/408 |
| 2010/0156159 | A1 | 6/2010 | Adams et al. | |
| 2013/0140866 | A1 * | 6/2013 | Yetukuri et al. | 297/408 |

OTHER PUBLICATIONS

Written Opinion of the International Searching Authority for PCT/US2011/047366; Mailed: Apr. 9, 2012.

* cited by examiner

11

FURNITURE MEMBER POWERED HEADREST ROTATION AND RELEASE SYSTEM

FIELD

The present disclosure relates to furniture member movable headrests operated by a power actuator.

BACKGROUND

This section provides background information related to the present disclosure which is not necessarily prior art.

Conventionally, reclining articles of furniture (i.e., chairs, sofas, loveseats, and the like), referred to hereinafter generally as reclining chairs, utilize a mechanism to bias a leg rest assembly in extended and stowed positions and separate components to allow a back seat member to recline with respect to a seat base. Occupant head rest support is commonly provided by one or more cushion members that abut with or are extensions of further cushion members acting as occupant back rest support members. The head rest support is commonly joined at its ends to vertically oriented backrest side support arms which are in turn rotatably connected to a furniture member chair frame.

Because head rest support is substantially fixed to the back seat member, as the back seat member rotates the head rest cushion(s) will commonly remain in a fixed orientation with respect to the seat back member. This can result in uncomfortable head rest support positions for the different rotated positions of the seat back. For example, with the seat back member rotated to a fully reclined position, the head rest may be rotated too far backward for comfortable viewing of a television or monitor. Also, with the seat back member rotated to a fully upright position, the head rest may be rotated too far forward for the comfort level desired by the occupant. The above head rest support systems are not adjustable by the occupant, and therefore can result in discomfort in either the fully reclined or fully upright positions, or in the leg rest extended position for different occupants.

Mechanical systems are therefore known which permit the headrest to be rotated by manual operation of a lever or link to provide multiple headrest adjustment positions. These systems may not provide for infinite adjustment of the headrest and may be difficult to operate by some occupants of the chair. Power actuated headrest designs are also known, however known power actuated headrest designs do not permit the power actuator to be completely released during headrest return travel should the headrest encounter an object blocking its return path.

SUMMARY

This section provides a general summary of the disclosure, and is not a comprehensive disclosure of its full scope or all of its features.

According to several embodiments, a furniture member powered headrest operating system includes a headrest frame assembly rotatably connected to a furniture member seatback frame. An actuation mechanism is connected to the seatback frame. The actuation mechanism has a power actuated member connected to the headrest frame assembly operating to rotate the headrest frame assembly from a fully retracted to a fully forward rotated position inclusive. A biasing member is connected to the furniture member seatback frame and the headrest frame assembly. A biasing force created during rotation of the headrest frame assembly away from the fully retracted position operates without an operating force of the actuation mechanism to bias the headrest frame assembly from the fully forward rotated position to the fully retracted position.

According to other embodiments, a furniture member powered headrest operating system includes a headrest frame assembly rotatably connected to a furniture member seatback frame using first and second rotational pins. An actuation mechanism is rotatably connected to the seatback frame. The actuation mechanism has a power actuated member connected to the headrest frame assembly operating between a retracted to an extended position to rotate the headrest frame assembly from a fully retracted to a fully forward rotated position about a frame assembly axis of rotation defined by the first and second rotational pins. A release system rotatably connects the headrest frame assembly to the actuation mechanism permitting the headrest frame assembly to be retained at any forward rotated position while the actuation mechanism returns the power actuated member from the extended to the retracted positions if the headrest frame assembly encounters an object blocking return to the fully retracted position.

According to further embodiments, a furniture member powered headrest operating system includes a biasing member connected to the furniture member seatback frame and the headrest frame assembly. A biasing force created during rotation of the headrest frame assembly away from the fully retracted position operates without an operating force of the actuation mechanism to bias the headrest frame assembly from the fully forward rotated position to the fully retracted position. A release system rotatably connecting the headrest frame assembly to the actuation mechanism permits the headrest frame assembly to be retained at any forward rotated position while the actuation mechanism returns the power actuated member from the extended to the retracted positions if the headrest frame assembly encounters an object blocking return to the fully retracted position. The biasing member provides the biasing force required to return the headrest frame assembly to the fully retracted position after removal of the object.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
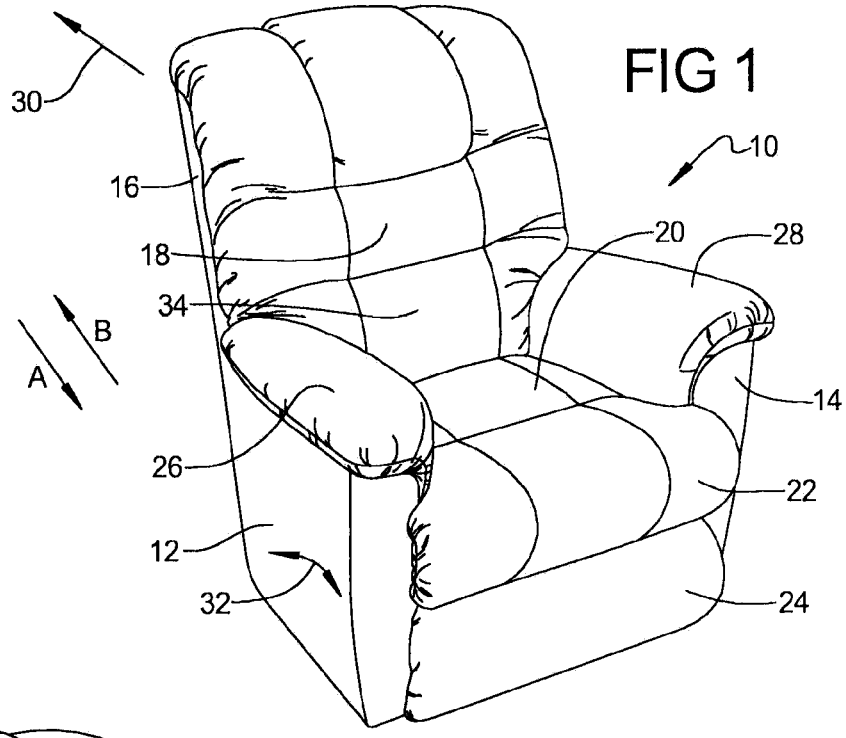
FIG. 1 is a front perspective view of a furniture member having a powered headrest rotation and release system of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
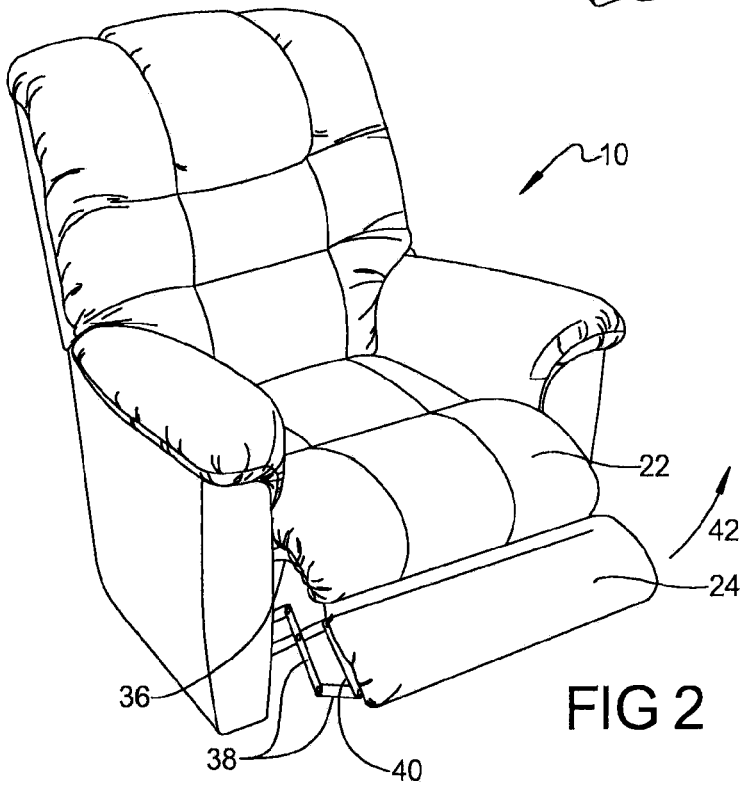
FIG. 2 is a front perspective view of the furniture member of FIG. 1 having a leg rest assembly shown in an extended position.

Referring generally to FIG. 1, a furniture member 10 depicted as a rocking-reclining chair includes first and second sides 12, 14 and an occupant seatback frame 16 covered with a seatback cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14 respectively. An occupant's weight generally centered on support member 20 is normally operable to maintain seatback frame 16 in an upright position. When the leg rest assembly 24 is positioned in a stowed or fully retracted position shown, seatback frame 16 can be manually reclined or rotated with respect to a seatback arc of rotation 30. Seatback frame 16 can rotate about arc of rotation 30 from the upright position shown to a fully reclined position (not shown). Seatback frame 16 returns to the upright position shown and opposite to seatback arc of rotation 30 when desired by the occupant, and leg rest assembly 24 can similarly be returned from a fully extended position (shown in reference to FIG. 2) to the fully retracted position shown.

According several embodiments, furniture member 10 can independently rotate or rock forwardly and rearwardly about a furniture member arc of rotation 32 by motion of the occupant and without requiring powered operation. A lumbar support section 34 can be provided which can be moved either in a lumbar extension direction "A" to increase occupant lumbar support or in a lumbar retraction direction "B" to decrease occupant lumbar support. In the embodiment shown, furniture member 10 is depicted as a chair however the present teachings are not limited to chairs. Furniture member 10 can be any of a plurality of furniture members, including, but not limited to single or multiple person furniture members, sofas, sectional members and/or loveseats.

Referring to FIG. 2 and again to FIG. 1, an actuation mechanism 36 can be either a manual or a power actuated device controlled by the occupant to direct the repositioning of leg rest assembly 24 from the stowed position (shown in FIG. 1) to an extended position. Actuation mechanism 36 supports and permits both extension and retraction of leg rest assembly 24, as well as rotation of seatback frame 16. More specifically, actuation mechanism 36 includes first and second pantograph linkage sets 38, 38' (second pantograph linkage set 38' is not visible in this view) which are linked to leg rest assembly 24 using first and second leg rest support arms 40, 40' (only first leg rest support arm 40' is visible in this view). Leg rest assembly 24 can be moved from the fully retracted position (shown in FIG. 1) to an extended position by motion of the leg rest assembly 24 about a leg rest extension arc 42. It will be apparent that rotation of leg rest assembly 24 in an opposite direction from extension arc 42 will return leg rest assembly 24 to the retracted position.

Figure 3:
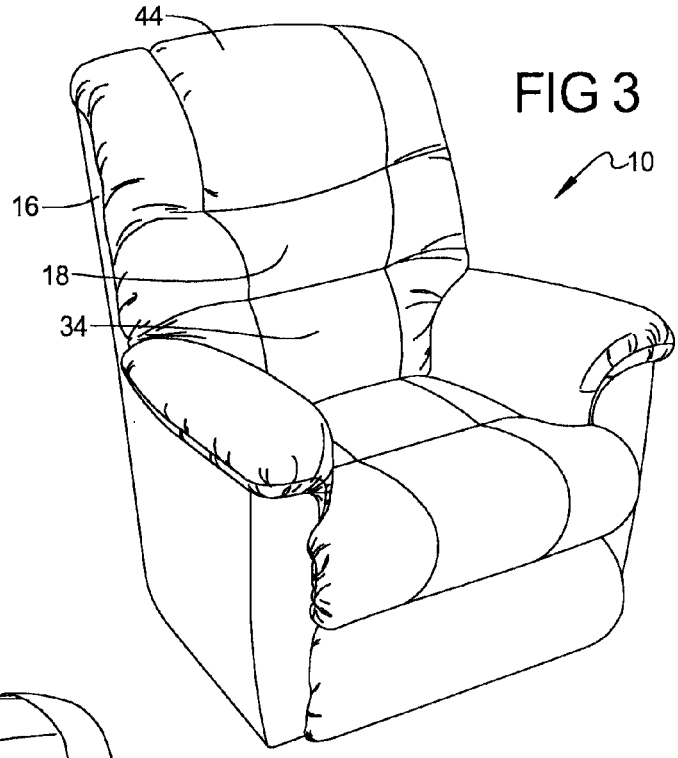
FIG. 3 is a front perspective view of a furniture member of FIG. 1 having a headrest assembly in a fully retracted position.

Referring to FIG. 3, a headrest member 44 having an upholstery covering is separately connected to and independently rotatable with respect to seatback frame 16. Headrest member 44 is positioned to provide support for an occupant's head and neck in all operating positions of furniture member 10. Headrest member 44 is shown positioned in a fully retracted position.

Figure 4:
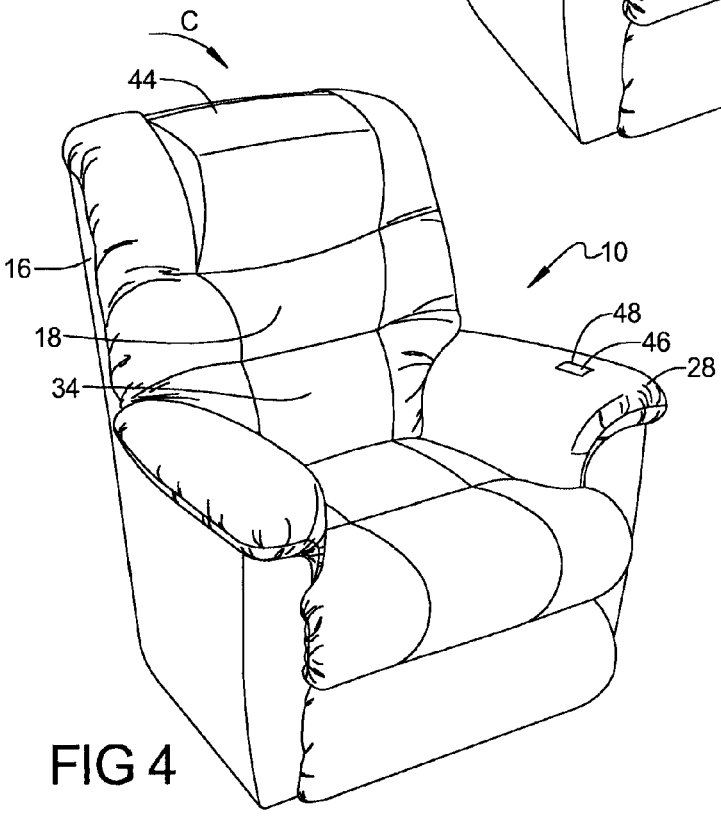
FIG. 4 is a front perspective view of the furniture member of FIG. 3 having the headrest assembly shown in a fully extended position.

Referring to FIG. 4, headrest member 44 is rotated to a fully forward rotated position. Headrest member 44 is rotatable in a headrest member arc of rotation "C". According to several embodiments, headrest member 44 is moved by power at the command of the furniture member occupant between the fully retracted and fully forward rotated positions. Operation of headrest member 44 can be by actuation of a switch or similar actuation device 46 which can be positioned at any conveniently accessible position on furniture member 10, and is provided on a control unit 48 in an exemplary position on second armrest pad 28 of second side 14. It will be apparent that rotation of headrest member 44 in an opposite direction from arc of rotation "C" will return headrest member 44 to the fully retracted position shown in FIG. 3.

Figure 5:
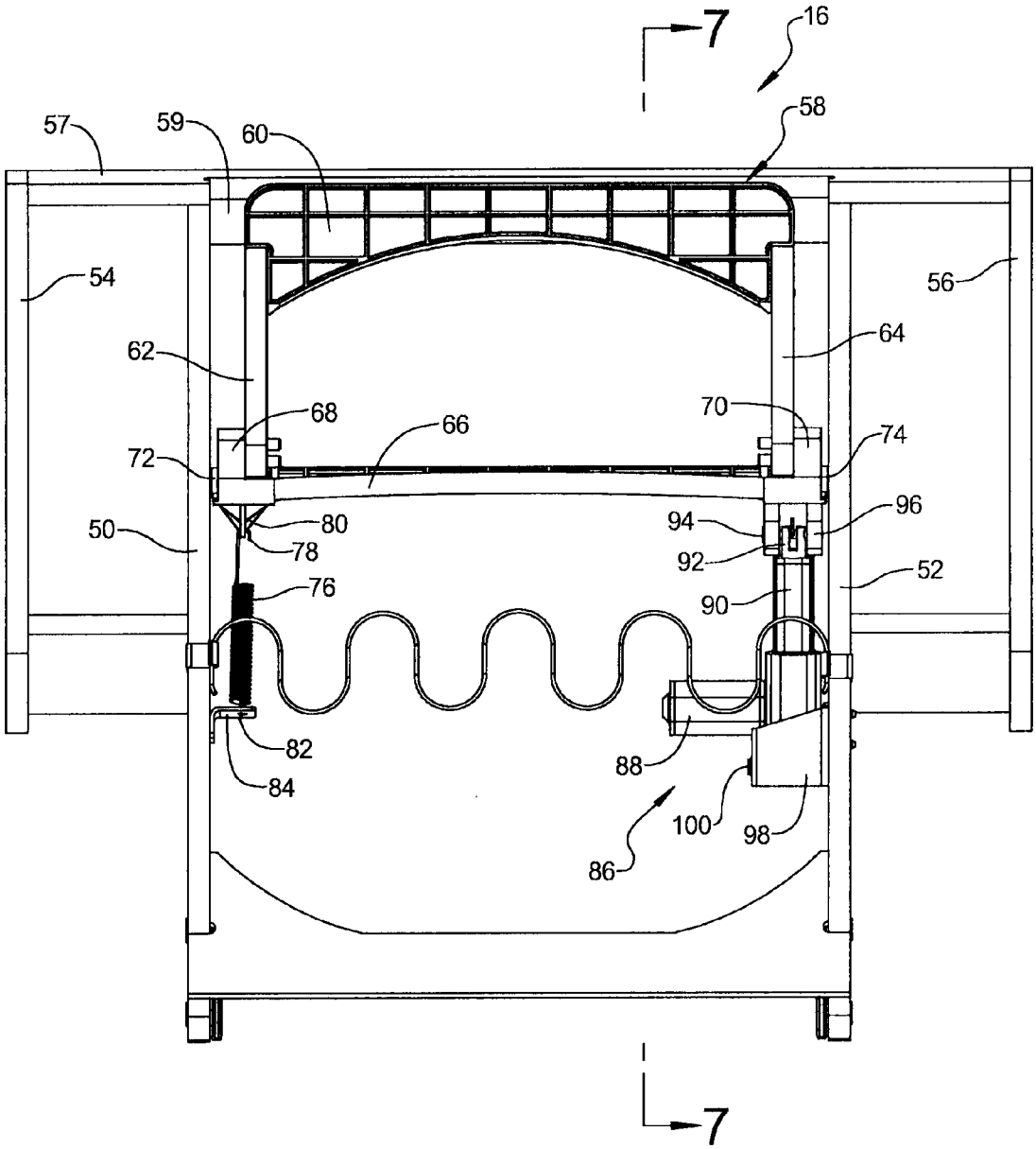
FIG. 5 is a front elevational view of the seatback assembly of the furniture member of FIG. 1 having the upholstery removed for clarity.

Referring to FIG. 5, seatback frame 16 is shown having upholstery and any padding removed such that only a frame and supported elements are visible for clarity. Seatback frame 16 includes each of a first and a second seatback side member 50, 52 which according to several embodiments are constructed of a wood material, and first and second extension wings 54, 56 connected to and extending outwardly with respect to the first and second seatback side members 50, 52, also constructed of wood. A seatback upper frame member 57 connects to and braces each of the first and second seatback side members 50, 52 and first and second extension wings 54, 56. An upper brace member 59 can also be included which is connected at opposite ends to the first and second seatback side members 50, 52 to additionally structurally support these members.

A headrest frame assembly 58 is rotatably connected to both first and second seatback side members 50, 52. Headrest frame assembly 58 includes a first cross member 60 connected to each of first and second side members 62, 64. A second cross member 66 is oppositely positioned with respect to first cross member 60 and is also connected to first and second side members 62, 64. First and second connecting joints 68, 70 made of a polymeric material are connected at second cross member 66 and individually to first and second side members 62, 64. According to several embodiments, the members of headrest frame assembly 58 are molded from a polymeric material to provide rigidity and light weight. According to other embodiments, the members of headrest frame assembly 58 are made from a wood material. A first rotational pin 72 rotatably connects first connecting joint 68 to first seatback side member 50. Similarly, a second rotational pin 74 rotatably connects second connecting joint 70 to first seatback side member 50.

Headrest frame assembly 58 is normally biased to a fully upright, fully retracted position shown by a biasing force of a biasing member 76 such as a compression spring, made for example from a spring steel. Biasing member 76 includes a first hooked end 78 connected to an extending structure 80 integrally or homogeneously connected to first connecting joint 68 and therefore also made of a polymeric material. Biasing member 76 also includes a second hooked end 82 connected to a bracket 84 fastened to an inward directed face of first seatback side member 50.

Figure 11:
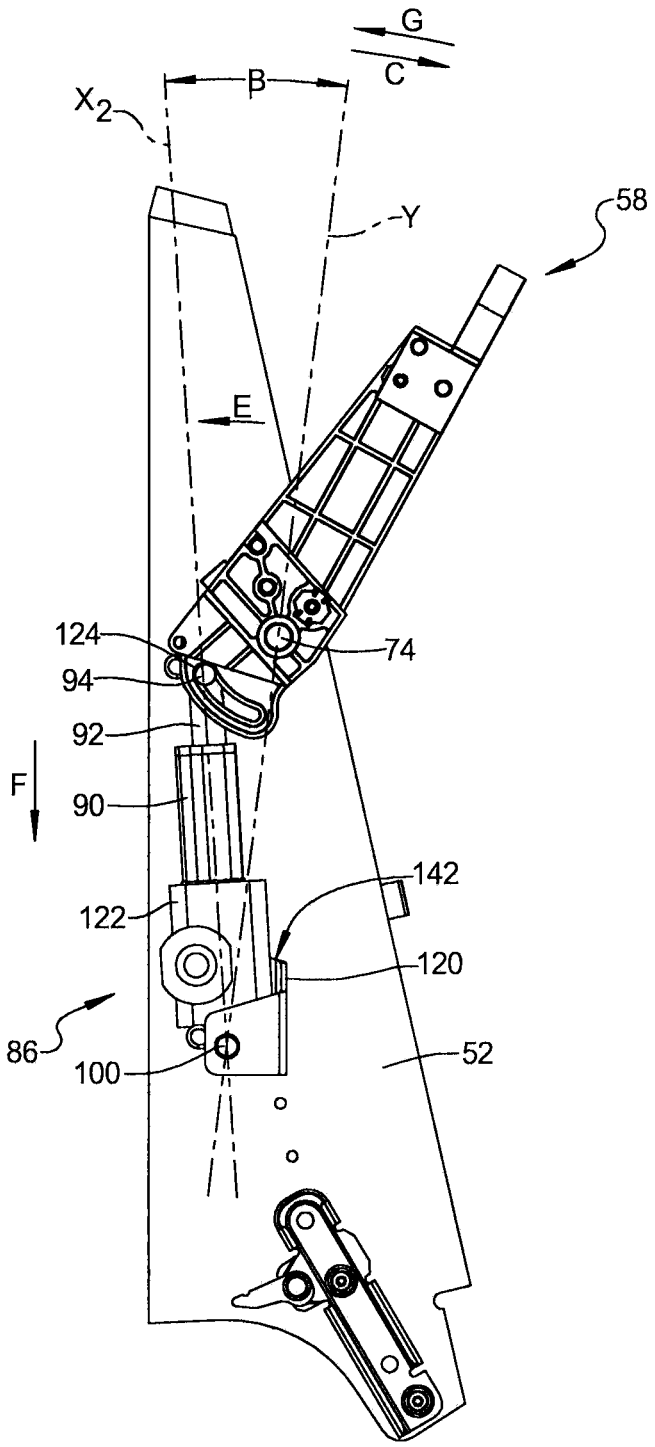
FIG. 11 is a side elevational view taken at section 11 of FIG. 9.

Headrest frame assembly 58 is power displaced in a forward direction by an actuation mechanism 86 having an electrical actuator 88 and a receiver 90. A power actuated member such as an axially displaceable member 92 is axially extendable and retractable into and out of a receiver 90 by operation of electrical actuator 88. An extending end of axially displaceable member 92 is rotatably pinned by a rotational pin 94 to a pin connecting bracket 96 integrally or homogeneously connected to second connecting joint 70 and therefore also made of a polymeric material. Headrest frame assembly 58 is positioned in the upright, fully retracted position when axially displaceable member 92 is fully retracted into receiver 90 as shown. A mechanism mounting bracket 98 is fastened to an inward directed face of second seatback side member 52. Actuation mechanism 86 is rotatably connected to mechanism mounting bracket 98 using a mechanism mounting pin 100. Mechanism mounting pin 100 permits rotation of actuation mechanism 86 during rotation of headrest frame assembly 58, as will be better described in reference to FIGS. 7 and 11.

Figure 6:
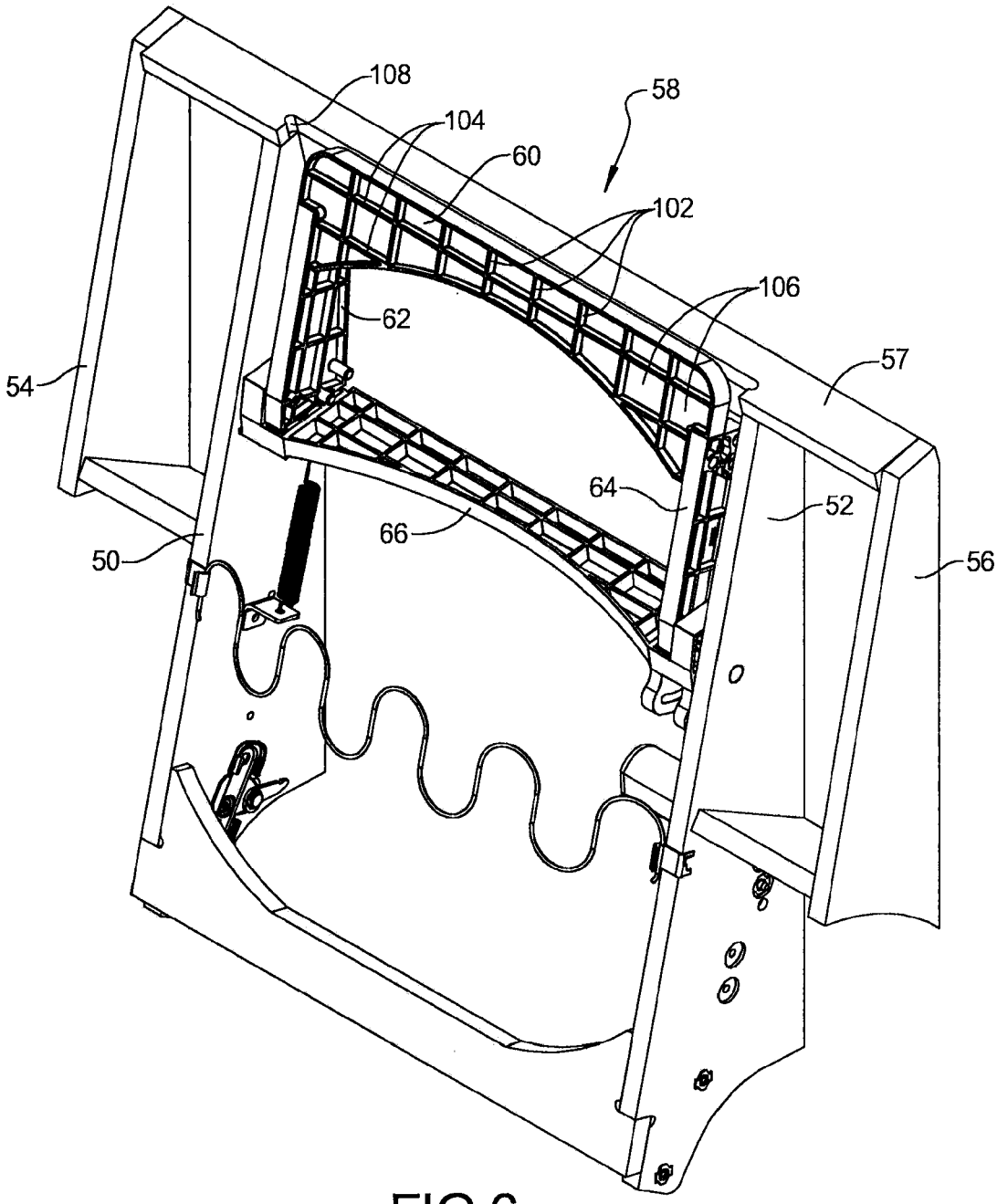
FIG. 6 is a front left perspective view of the seatback assembly of FIG. 5.

Referring to FIG. 6, further design features of the members of headrest frame assembly 58 when headrest frame assembly 58 is constructed of a polymeric material include a plurality of support ribs 102 which are oriented perpendicular with respect to a plurality of support frames 104. Support ribs 102 and support frames 104 provide structural rigidity, permitting a thickness of a plurality of panels 106 positioned between, homogeneously connected to, and supported by the support ribs 102 and support frames 104 to be minimized. In addition to first cross member 60 shown, each of the first and second side members 62, 64 and the second cross member 66 also include a similar plurality of support ribs 102 and support frames 104. When a different material such as wood is used to construct headrest frame assembly 58, support ribs 102 and support frames 104 are not present and individual panels 106 are therefore not required. When rotated to the fully retracted position shown in FIG. 6, headrest frame assembly 58 is positioned partially within a recess 108 created in seatback upper frame member 57. This permits the forward facing surfaces of headrest frame assembly 58 to be aligned substantially co-planar with the forward facing edges of first and second seatback side members 50, 52. The remainder of headrest frame assembly 58 is entirely positioned within a space envelope defined between first and second seatback side members 50, 52.

Figure 7:
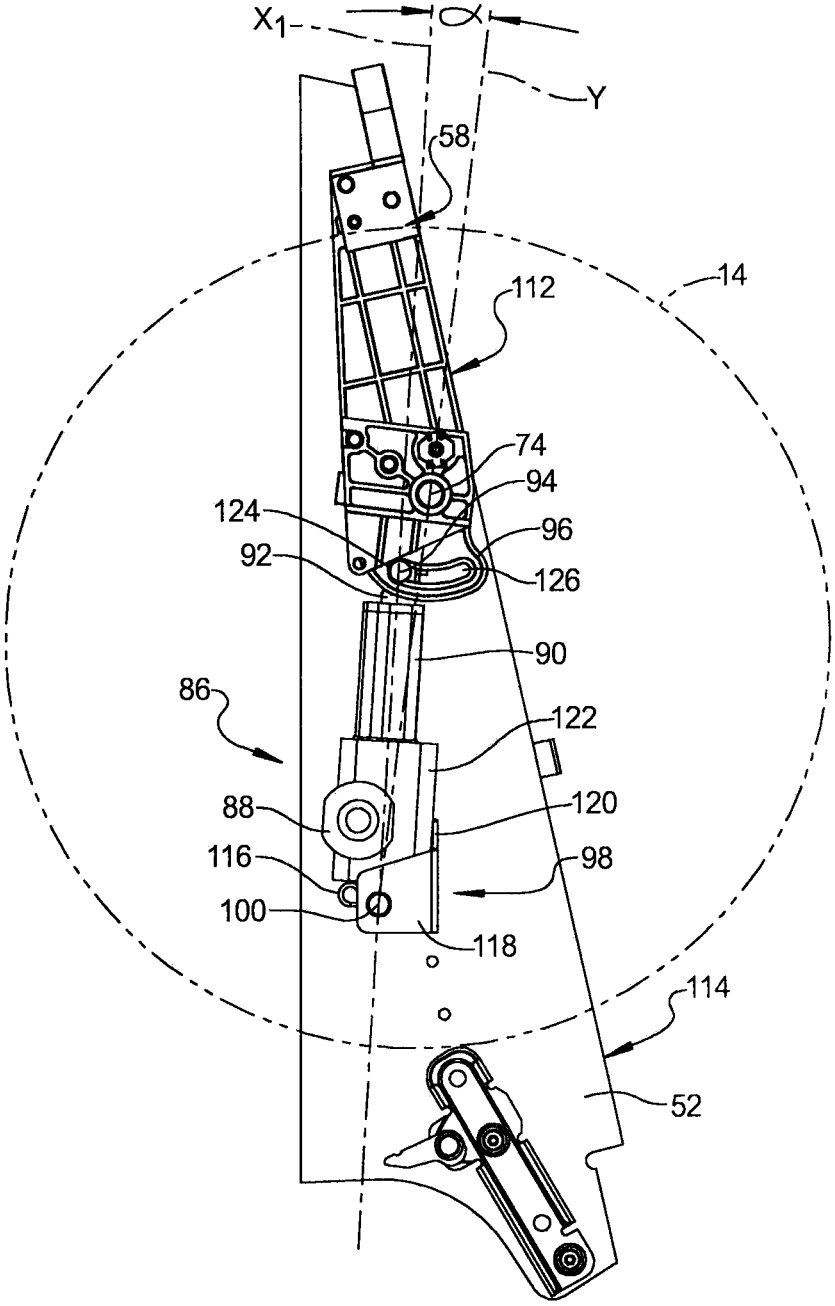
FIG. 7 is a side elevational view taken at section 7 of FIG. 5.

Referring to FIG. 7, when headrest frame assembly 58 is at the fully retracted position, an actuation mechanism longitudinal axis "$X_1$" is defined through a center of mechanism mounting pin 100 and a center of rotational pin 94. A second rotational pin locating axis "Y" is defined through the center of mechanism mounting pin 100 and a center axis of second rotational pin 74. A first separation angle α is defined between actuation mechanism longitudinal axis "$X_1$" and second rotational pin locating axis "Y". A fastener 116 such as a clevis pin can be used to releasably couple actuation mechanism 86 to mechanism mounting pin 100. Mechanism mounting pin 100 is rotatably received through a first bracket flange 118 and a second bracket flange 119 (not visible in this view) having second bracket flange 119 fastened to second seatback side member 52. First and second bracket flanges 118, 119 are commonly joined to a bracket base 120. First and second bracket flanges 118, 119 and bracket base 120 together define a substantially U-shaped bracket, which is non-rotationally fixed with respect to second seatback side member 52.

When headrest frame assembly 58 is in the fully retracted position, axially displaceable member 92 is fully retracted within receiver 90. Receiver 90 is, in turn, connected to a housing 122 having for example internal gears (not shown) actuated by operation of electrical actuator 88 to extend or retract axially displaceable member 92. Housing 122 is in contact with bracket base 120 when headrest frame assembly 58 is in the fully retracted position. Also in the fully retracted position, rotational pin 94 contacts a first slot end wall 124 of a semi-circular slot 126 created in each of the first and second pin connecting brackets (only first pin connecting bracket 96 is visible in this view). As previously noted, in the fully retracted position of headrest frame assembly 58, a frame assembly face 112 is positioned substantially co-planar to a seatback side member face 114 of second seatback side member 52.

Figure 8:
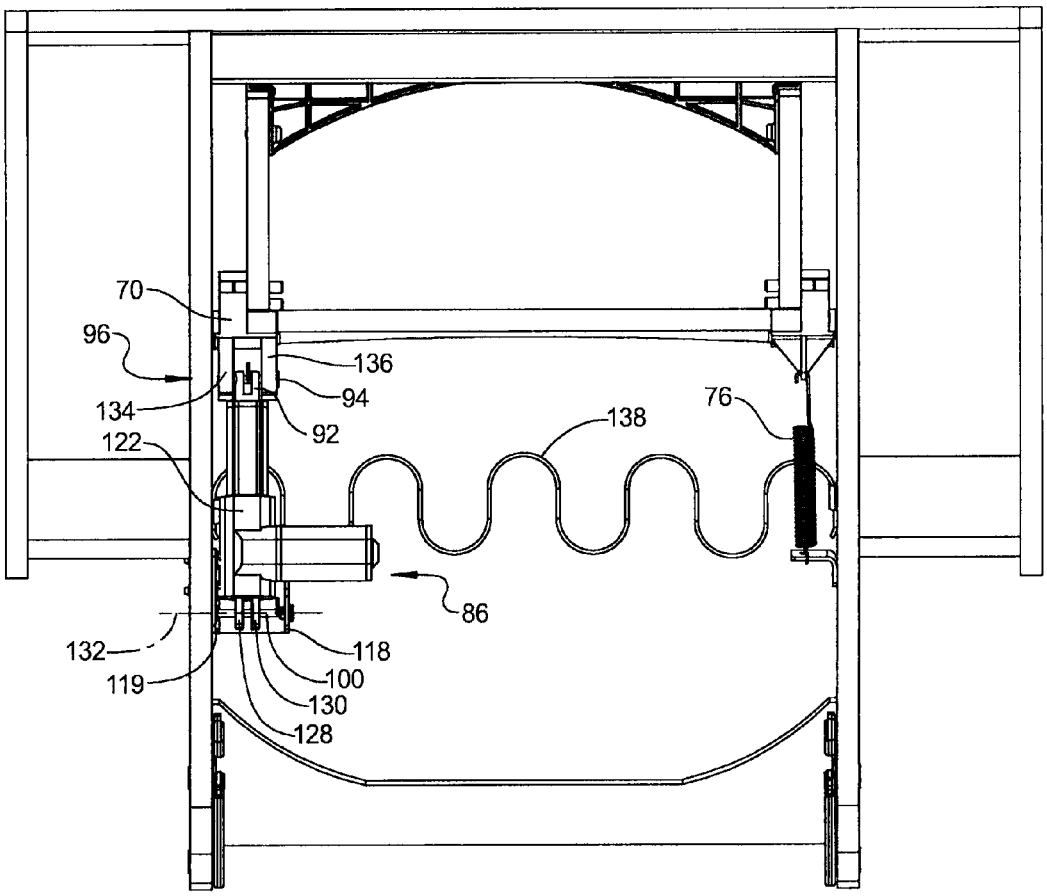
FIG. 8 is a rear elevational view of the seatback assembly of FIG. 5.

Referring to FIG. 8, first and second mounting arms 128, 130, integrally or homogeneously connected to gear housing 122, define a rotational support base for gear housing 122 and, thereby, for actuation mechanism 86. Mechanism mounting pin 100 is slidably inserted through co-axial apertures (not shown) created in each of a first and second mounting arm 128, 130 such that a mounting pin axis of rotation 132 is defined through mechanism mounting pin 100 for actuation mechanism 86. At the opposite end of actuation mechanism 86, axially displaceable member 92 is rotatably connected using rotational pin 94 to each of a first and a second connecting arm 134, 136 integrally or homogeneously connected to second connecting joint 70. First and second connecting arms 134, 136 collectively define first pin connecting bracket 96. As clearly evident in FIG. 8, the entire configuration of actuation mechanism 86, as well as biasing member 76, is positioned rearwardly of a back support member 138 shown in this example as a sinuous wire spring. Back support member 138 can therefore rearwardly elastically deflect without contacting either actuation mechanism 86 or biasing member 76.

Figure 9:
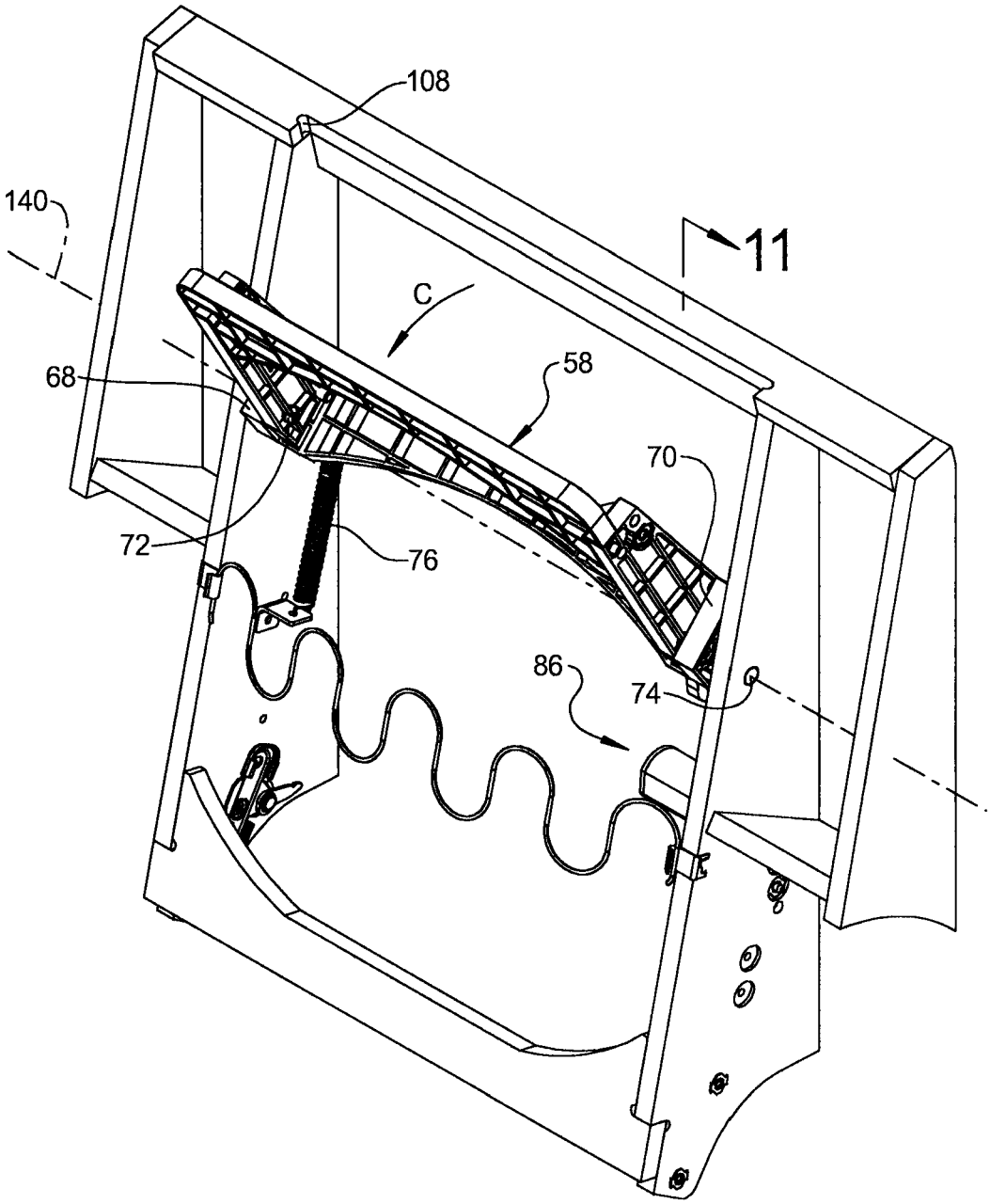
FIG. 9 is a front left perspective view of the seatback assembly of FIG. 5 showing the headrest frame assembly in a forward rotated position.

Referring to FIG. 9, when actuation mechanism 86 is operated to rotate headrest frame assembly 58 in the headrest member forward arc of rotation "C", headrest frame assembly 58 rotates out of recess 108 and forwardly in the headrest member forward arc of rotation "C" with respect to a frame assembly axis of rotation 140 defined through first and second rotational pins 72, 74. First and second rotational pins 72, 74 are individually and directly connected to and extend outwardly from first and second connecting joints 68, 70, respectively. Forward rotation of headrest frame assembly 58 also causes axial elongation of biasing member 76, thereby increasing the potential force stored by biasing member 76, which will be subsequently used to return headrest frame assembly 58 to the fully retracted position.

Figure 10:
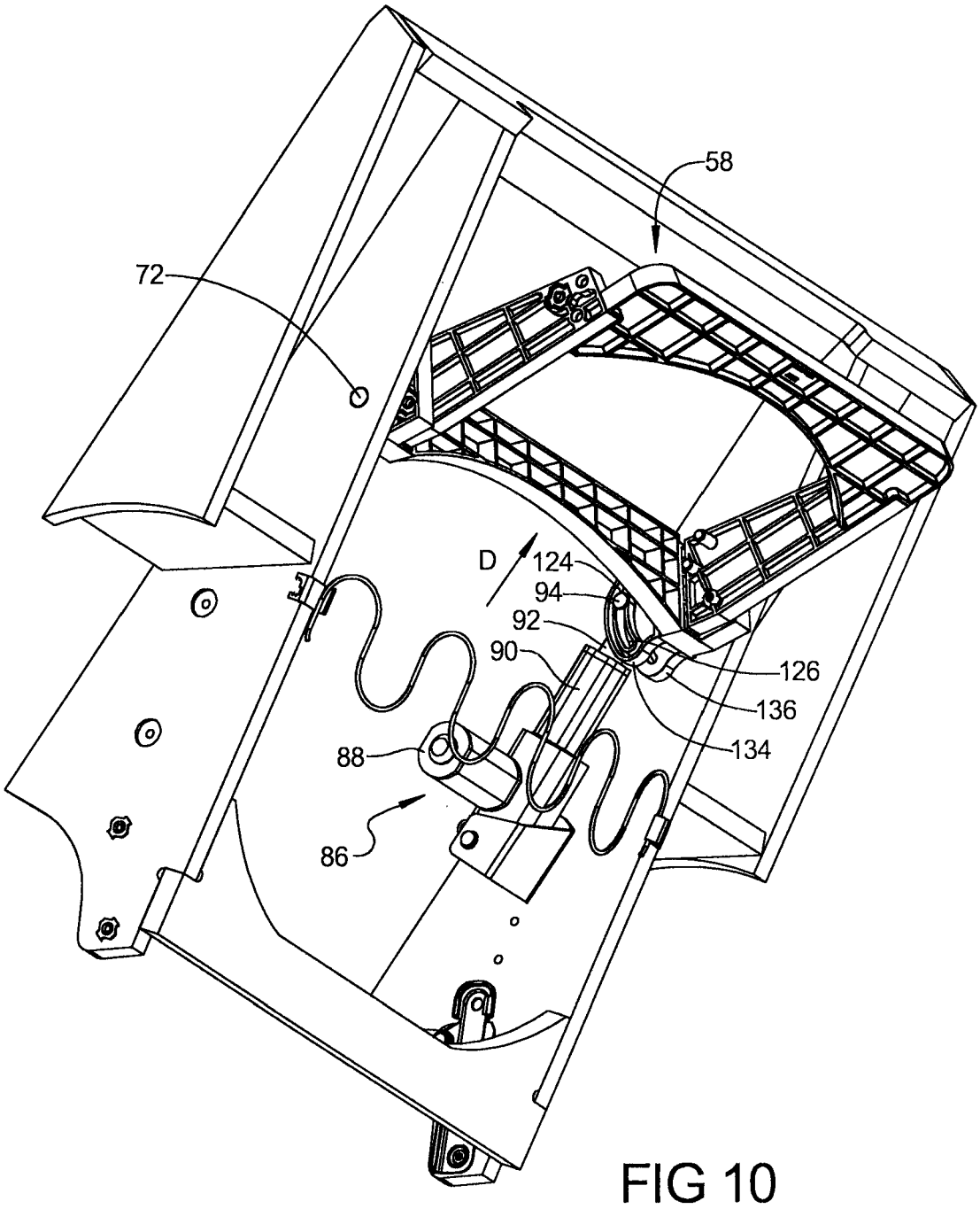
FIG. 10 is a front left perspective view of the seatback assembly of FIG. 9.

Referring to FIG. 10, as axially displaceable member 92 extends out of receiver 90 to a fully extended position, rotational pin 94 which directly contacts first slot end wall 124 of semi-circular slot 126 forces headrest frame assembly 58 to rotate to the fully forward rotated position. Axially displaceable member 92 extends in an extension direction "D" and is retained in the fully extended position shown until electrical actuator 88 is operated to retract axially displaceable member 92 into receiver 90. The fully extended position of axially displaceable member 92 overcomes the biasing force of biasing member 76 to retain headrest frame assembly 58 in any forward rotated position including the fully forward rotated position when axially displaceable member 92 is in direct contact with first slot end wall 124. Headrest frame assembly 58 can be positioned and retained in any position between the fully retracted position and the fully forward rotated position by operation of electrical actuator 88 positioning axially displaceable member 92 anywhere from the fully retracted position to the fully extended position inclusive.

Referring to FIG. 11 and again to FIG. 7, in order to reach the fully forward rotated position of headrest frame assembly 58, actuation mechanism 86 also rotates in a first actuation mechanism direction of rotation "E" about mechanism mounting pin 100 such that the actuation mechanism longitudinal axis is moved to the position shown as actuation mechanism longitudinal axis "$X_2$". A second separation angle β is thereby established, which is greater than first separation angle α. As actuation mechanism 86 rotates in the first actuation mechanism direction of rotation "E", a clearance gap 142 is created between gear housing 122 and bracket base 120. It is noted that upon full rotation of actuation mechanism 86, actuation mechanism 86 is still fully retained within the space envelope defined by second seatback side member 52. The off-center position of rotational pin 94 with respect to second rotational pin 74 thereby creates a cantilever force causing forward rotation of headrest frame assembly 58 in the headrest member forward arc of rotation "C". In order to return headrest frame assembly 58 from the fully forward rotated position shown to the fully retracted position, actuation mechanism 86 is again operated to retract axially displaceable member 92 into receiver 90, which allows rotation of headrest frame assembly 58 in a headrest member rearward arc of rotation "G" by the biasing force of biasing member 76. Headrest frame assembly 58 will continue to rotate in the headrest member rearward arc of rotation "G" until axially displaceable member 92 is fully retracted into receiver 90 in a member retraction direction "F".

Referring to FIG. 12 and again to FIG. 9, if an object 144 is positioned between headrest frame assembly 58 and either first or second seatback side member 50, 52 or seatback upper frame member 57, the powered retraction of axially displaceable member 92 into receiver 90 in the member retraction direction "F" can continue even with object 144 in place. In this situation, headrest frame assembly 58 can remain in any forward rotated position including the fully forward rotated position by operation of a release system 145 as follows. Rotational pin 94 will release from its contact position with first slot end wall 124 and slidably move within semi-circular slot 126 to a second slot end wall 146 of semi-circular slot 126. With continuing reference to FIG. 9, powered operation of actuation mechanism 86 will cease when axially displaceable member 92 is fully retracted into receiver 90. Thereafter, the biasing force of biasing member 76 is continuously available to return headrest frame assembly 58 to the fully retracted position once the object 144 has been removed. Therefore, even though actuation mechanism 86 has returned to its forward rotated position by rotation about a second actuation mechanism direction of rotation "H", release system 145 substantially releases the holding force generated by actuation mechanism 86, leaving only the biasing force of biasing member 76 applied to headrest frame assembly 58.

With continued reference to FIG. 12 and again to FIGS. 5 and 6, the space between headrest frame assembly 58 and the first and second seatback side members 50, 52 and/or seatback upper frame member 57 can be at least partially enclosed by upholstery (not shown) such as foam, leather, or the like. The upholstery can include one or more flaps (not shown) that fold or collapse when headrest frame assembly 58 is in the fully retracted position, and that extend or expand when headrest frame assembly 58 rotates to the fully forward rotated position to partially fill the space.

Figure 12:
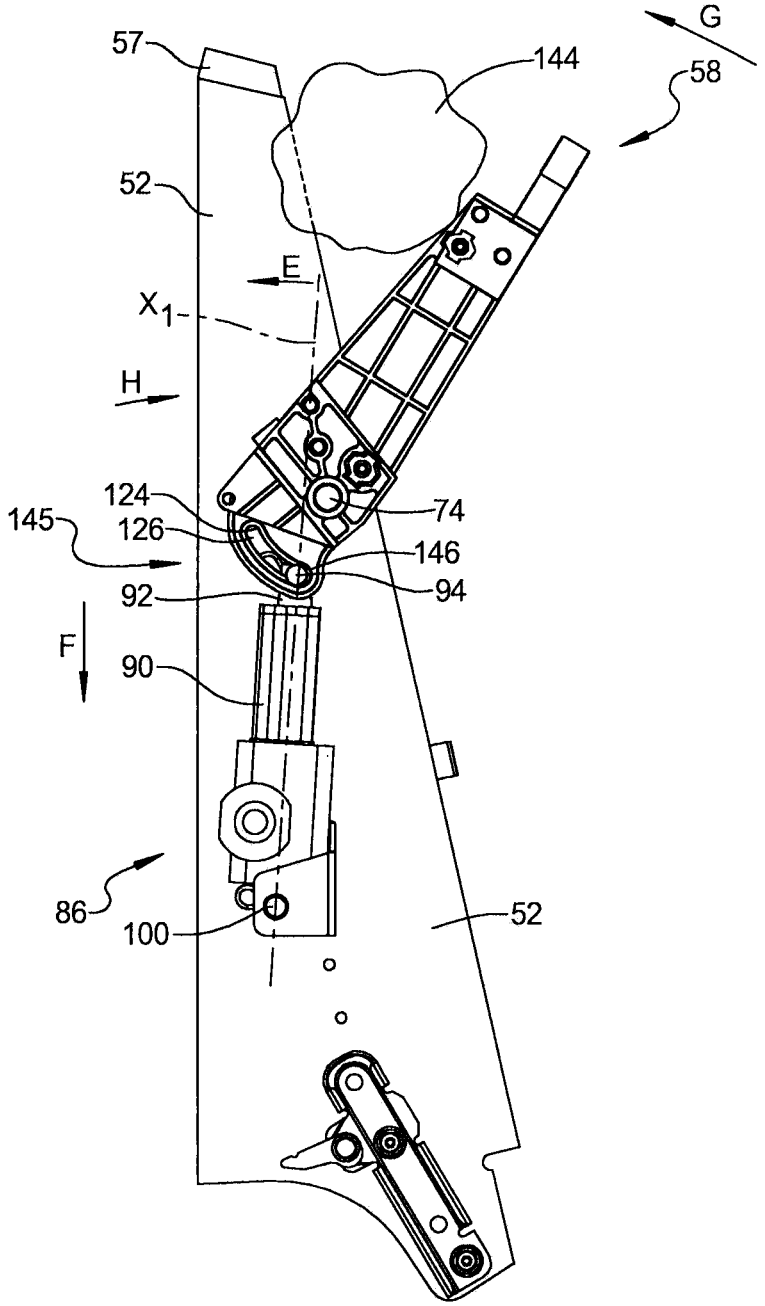
FIG. 12 is the side elevational view of FIG. 11 further showing the headrest frame assembly in a release position.
Figure 13:
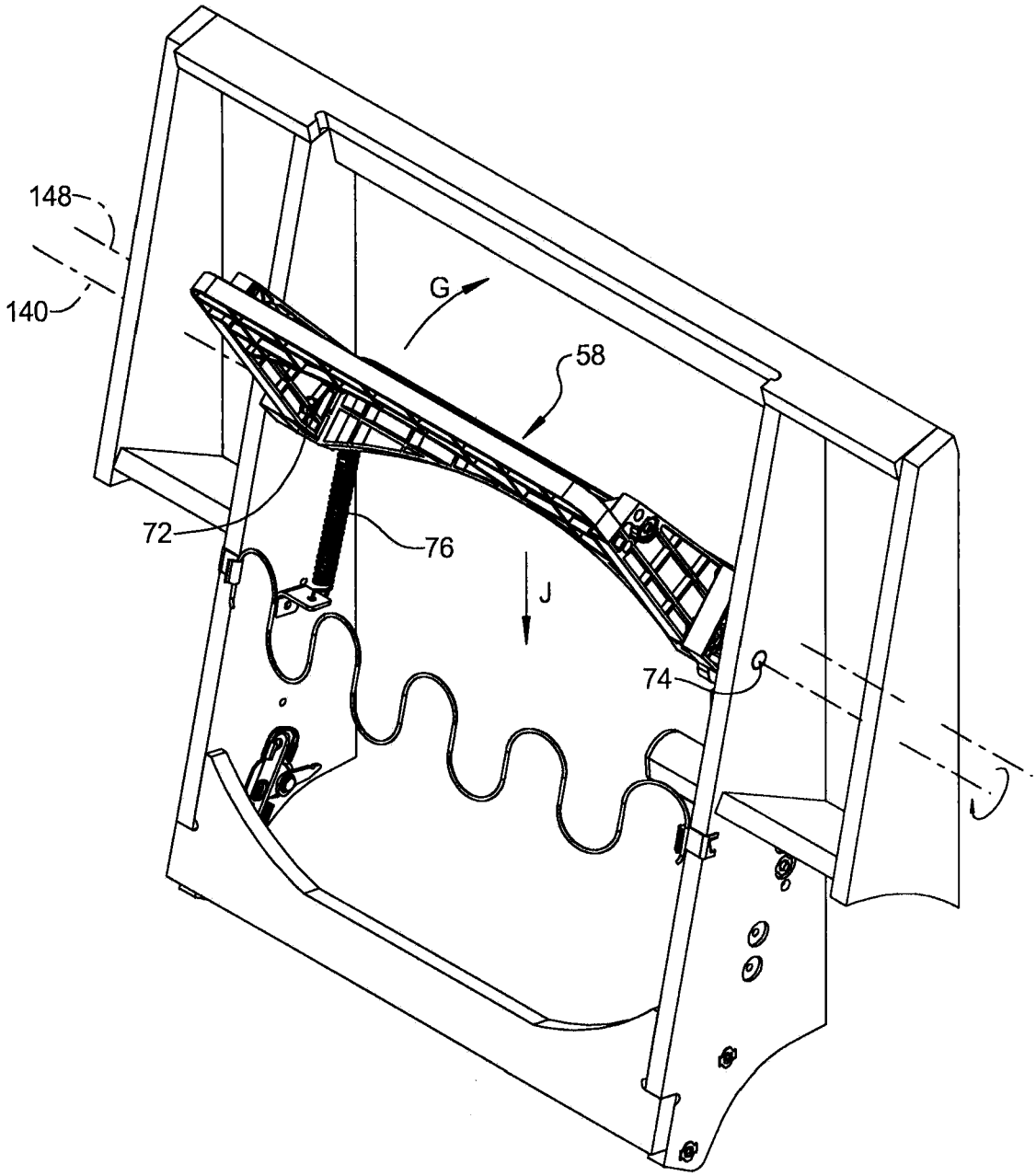
FIG. 13 is a front left perspective view of the seatback assembly of FIG. 12 following removal of the object blocking free rotation of the headrest frame assembly.

Referring to FIG. 13, and again to FIG. 12, biasing member 76 creates a biasing force acting in a biasing member direction of force "J" to return headrest frame assembly 58 to the fully retracted position about headrest member rearward arc of rotation "G". A biasing member axis of connection 148, defined at the contact point between biasing member 76 and headrest frame assembly 58, is positioned rearwardly of frame assembly axis of rotation 140. This offset between the point of application of the biasing force of biasing member 76 and the frame assembly axis of rotation 140 allows biasing member 76 to provide a continuous biasing force to return headrest frame assembly 58 in the headrest member rearward arc of rotation "G".

Figure 14:
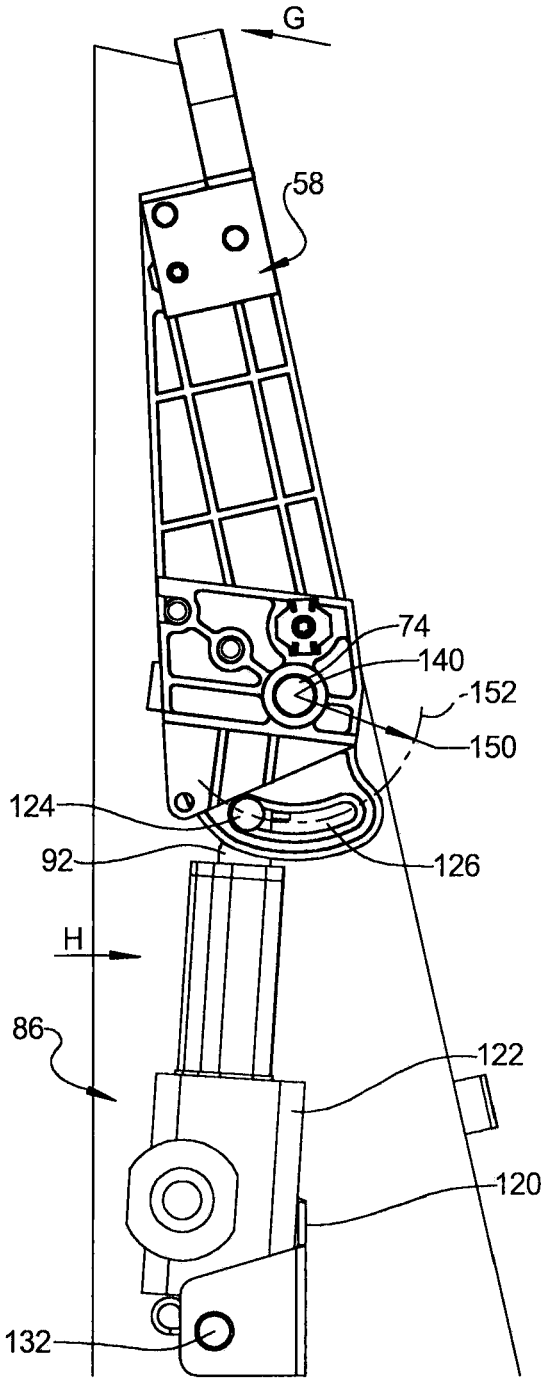
FIG. 14 is a side elevational view similar to FIG. 7.

Referring to FIG. 14, semi-circular slot 126 is defined by a radius of curvature 150 defining an arc of curvature 152 for semi-circular slot 126. Radius of curvature 150 is defined with respect to the frame assembly axis of rotation 140 extending through second rotational pin 74. This permits unrestricted rotation of headrest frame assembly 58 about the frame assembly axis of rotation 140 regardless of the position of second rotational pin 74 within semi-circular slot 126. Therefore, even following the rotation of actuation mechanism 86 with respect to second actuation mechanism direction of rotation "H", headrest frame assembly 58 is free to rotate with respect to frame assembly axis of rotation 140.

The furniture member powered headrest and release systems of the present disclosure offer several advantages. By connecting a power actuated member to a headrest frame assembly that is rotatably connected to a furniture seatback frame, the headrest frame assembly can be power rotated between a fully retracted and a fully forward rotated position, inclusive, to provide a power displacement, infinitely adjustable occupant headrest support. By further connecting a biasing member to the headrest frame assembly, the headrest frame assembly can be returned from the fully forward rotated position to the fully retracted position in a non-powered operation using the biasing force of the biasing member. The use of the biasing member for retraction of the headrest frame assembly further permits a release system to be incorporated which stops return rotation of the headrest frame assembly if an object blocks the rotational path of the headrest frame assembly during return. The release system can include a semi-circular slot in which a rotational pin connected to the headrest frame assembly is disposed. The rotational pin can slide in the semi-circular slot to permit the headrest frame assembly to freely rotate independently of the actuation mechanism during a powered retraction motion of the actuation mechanism.

The actuation mechanism 86 is described herein as an electrically operated actuator axially or linearly moving a displaceable member in and out with respect to a receiver. The present disclosure is not limited to electrically operated actuators. Other actuators such as air or hydraulically operated actuators, rotating actuators, and the like can also be used within the scope of the present disclosure. The axially displaceable member 92 can also be replaced by a rotational member, a horizontally displaced member, or the like.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member powered headrest operating system, comprising:

a headrest frame assembly rotatably connected to a furniture member seatback frame; and an actuation mechanism connected to the seatback frame, the actuation mechanism having a power actuated member connected to the headrest frame assembly operating to rotate the headrest frame assembly between a fully retracted to a fully forward rotated position;

a biasing member connected to the furniture member seatback frame and the headrest frame assembly defining a biasing member axis of connection displaced with respect to a frame assembly axis of rotation to induce rotation of the headrest frame assembly from a biasing force of the biasing member, wherein the biasing force is created during rotation of the headrest frame assembly away from the fully retracted position and operates to bias the headrest frame assembly from the fully forward rotated position to the fully retracted position without an operating force of the actuation mechanism; and the seatback frame further including first and second seatback side members, the headrest frame including first and second rotational pins each rotatable connected to one of the first or second seatback side members, the first and second rotational pins defining a frame assembly axis of rotation.

2. The furniture member powered headrest operating system of claim 1, wherein the actuation mechanism further includes:

an actuator;

a receiver; and an axially displaceable member extendable and retractable with respect to the receiver in response to actuator operation, the axially displaceable member rotatably connected to the headrest frame assembly.

3. The furniture member powered headrest operating system of claim 2, further including;

at least one connecting bracket connected to the headrest frame assembly; and a rotational pin rotatably connecting the at least one connecting bracket to the axially displaceable member such that a fully extended position of the axially displaceable member corresponds to the fully forward rotated position of the headrest frame assembly.

4. A furniture member powered headrest operating system, comprising:

a headrest frame assembly rotatably connected to a furniture member seatback frame; and an actuation mechanism connected to the seatback frame, the actuation mechanism having a power actuated member connected to the headrest frame assembly operating to rotate the headrest frame assembly between a fully retracted to a fully forward rotated position;

a biasing member connected to the furniture member seatback frame and the headrest frame assembly, wherein a biasing force is created during rotation of the headrest frame assembly away from the fully retracted position which operates to bias the headrest frame assembly from the fully forward rotated position to the fully retracted position without an operating force of the actuation mechanism; and a release system rotatably connecting the headrest frame assembly to the actuation mechanism operating to permit rotation of the headrest frame assembly from the fully forward rotated position back to the fully retracted position by only a biasing force of the biasing member, wherein the release system includes:

a pin connecting bracket connected to the headrest frame assembly;

a semi-circular slot created in the pin connecting bracket; and a pin connected to the power actuated member of the actuation mechanism and slidably received in the semi-circular slot, wherein the pin contacts a first slot end wall of the semi-circular slot during rotation of the headrest from the fully retracted to the fully forward rotated positions, the pin slidably displaced toward a second slot end wall of the semi-circular slot during rotation from the fully forward rotated position to the fully retracted position if the headrest frame assembly encounters an object.

5. The furniture member powered headrest operating system of claim 1, wherein the actuation mechanism further includes an electrical actuator remotely controlled by an occupant of the furniture member.

6. A furniture member powered headrest operating system, comprising:

a headrest frame assembly rotatably connected to a furniture member seatback frame; and an actuation mechanism connected to the seatback frame, the actuation mechanism having a power actuated member connected to the headrest frame assembly operating to rotate the headrest frame assembly between a fully retracted to a fully forward rotated position;

a biasing member connected to the furniture member seatback frame and the headrest frame assembly, wherein a biasing force is created during rotation of the headrest frame assembly away from the fully retracted position which operates to bias the headrest frame assembly from the fully forward rotated position to the fully retracted position without an operating force of the actuation mechanism;

a mechanism mounting bracket fixedly connected to the furniture member seatback frame; and a mechanism mounting pin rotatably connecting the actuation mechanism to the mechanism mounting bracket such that the actuation mechanism is rotatable with respect to the mechanism mounting pin during rotation of the headrest frame assembly.

7. A furniture member powered headrest operating system, comprising:

a headrest frame assembly rotatably connected to a furniture member seatback frame using first and second rotational pins;

an actuation mechanism rotatably connected to the seatback frame, the actuation mechanism having a power actuated member connected to the headrest frame assembly operating between a retracted to an extended position to rotate the headrest frame assembly from a fully retracted to a fully forward rotated position about a frame assembly axis of rotation defined by the first and second rotational pins; and a release system rotatably connecting the headrest frame assembly to the actuation mechanism permitting the headrest frame assembly to be retained at any forward rotated position while the actuation mechanism returns the power actuated member from the extended to the retracted positions if the headrest frame assembly encounters an object blocking return to the fully retracted position.

8. The furniture member powered headrest operating system of claim 7, wherein the release system further includes:

first and second connecting arms connected to the headrest frame assembly; and a pin rotatably connecting the power actuated member to the first and second connecting arms.

9. The furniture member powered headrest operating system of claim 8, wherein the release system further includes:

a semi-circular slot created in each of the first and second connecting arms, the pin extending through the semi-circular slot of both the first and second connecting arms; and a first slot end wall of the semi-circular slot of each of the first and second connecting arms, the pin contacting the first slot end wall during a powered extension of the power actuated member, operating to positively rotate the headrest frame assembly from the fully retracted toward the fully forward rotated position.

10. The furniture member powered headrest operating system of claim 9, wherein the release system further includes a second slot end wall of the semi-circular slot of each of the first and second connecting arms, the pin slidably moving toward the second slot end wall during a powered retraction of the power actuated member when the headrest frame assembly encounters the object.

11. The furniture member powered headrest operating system of claim 7, further including a biasing member connected to the furniture member seatback frame and the headrest frame assembly, a biasing force created during rotation of the headrest frame assembly away from the fully retracted position operating without an operating force of the actuation mechanism to bias the headrest frame assembly from the fully forward rotated position to the fully retracted position.

12. The furniture member powered headrest operating system of claim 7, further including:

a mechanism mounting bracket fixedly connected to the furniture member seatback frame; and a mechanism mounting pin rotatably connecting the actuation mechanism to the mechanism mounting bracket such that the actuation mechanism is rotatable with respect to the mechanism mounting pin during rotation of the headrest frame assembly;

wherein the actuation mechanism is in contact with a bracket base of the mechanism mounting bracket when the headrest frame assembly is positioned in the fully retracted position, and a clearance gap is created between the actuation mechanism and the bracket base when the headrest frame is positioned in the fully forward rotated position.

13. The furniture member powered headrest operating system of claim 7, wherein the headrest frame assembly is rotatable in a first direction during rotation toward the fully forward rotation position and the actuation mechanism is rotatable in an opposite second direction during rotation of the headrest frame assembly toward the fully forward rotation position.

14. The furniture member powered headrest operating system of claim 7, wherein the headrest frame assembly further includes a plurality of both cross and side members connected to each other, the cross and side members each including:

polymeric support ribs;

polymeric support frames oriented perpendicular to the support ribs; and polymeric panels positioned between and supported by the support ribs and the support frames.

15. A furniture member powered headrest operating system, comprising:

a headrest frame assembly rotatably connected to a furniture member seatback frame using first and second rotational pins; and an actuation mechanism rotatably connected to the seatback frame, the actuation mechanism having a power actuated member connected to the headrest frame assembly operating from a retracted to an extended position to positively rotate the headrest frame assembly from a fully retracted to a fully forward rotated position;

a biasing member connected to the furniture member seatback frame and the headrest frame assembly, a biasing force created during rotation of the headrest frame assembly away from the fully retracted position operating without an operating force of the actuation mechanism to bias the headrest frame assembly from the fully forward rotated position to the fully retracted position; and a release system rotatably connecting the headrest frame assembly to the actuation mechanism permitting the headrest frame assembly to be retained at any forward rotated position while the actuation mechanism returns the power actuated member from the extended to the retracted positions if the headrest frame assembly encounters an object blocking return to the fully retracted position.

16. The furniture member powered headrest operating system of claim 15, wherein the release system includes:

first and second connecting joints connected to the headrest frame assembly having the first rotational pin extending from the first connecting joint and the second rotational pin connected to the second connecting joint;

first and second connecting arms extending from the actuation mechanism; and a pin rotatably connecting the power actuated member to the first and second connecting arms.

17. The furniture member powered headrest operating system of claim 16, further including a semi-circular slot created in each of the first and second connecting arms, the pin extending through the semi-circular slot of both the first and second connecting arms.

18. The furniture member powered headrest operating system of claim 17, further including a first slot end wall of the semi-circular slot of each of the first and second connecting arms, the pin contacting the first slot end wall during a powered extension of the power actuated member and operating to positively rotate the headrest frame assembly from the fully retracted toward the fully forward rotated position.

19. The furniture member powered headrest operating system of claim 18, further including a second slot end wall of the semi-circular slot of each of the first and second connecting arms, the pin slidably moving toward the second slot end wall during a powered retraction of the power actuated member when the headrest frame assembly encounters the object.

20. The furniture member powered headrest operating system of claim 17, wherein an arc of curvature of the semi-circular slot is defined by a radius of curvature extending from a centerline of the pin extending through the semi-circular slot of both the first and second connecting arms.

21. The furniture member powered headrest operating system of claim 15, further including a mechanism mounting bracket fixedly connected to the furniture member seatback frame.

22. The furniture member powered headrest operating system of claim 21, wherein the actuator mechanism further includes:

a housing supporting a receiver which slidably supports the power actuated member; and at least one mounting arm extending from the housing.

23. The furniture member powered headrest operating system of claim 22, further including a mechanism mounting pin rotatably connecting the at least one mounting arm to the mechanism mounting bracket such that the actuation mechanism is rotatable with respect to the mechanism mounting pin during rotation of the headrest frame assembly.

* * * * *